United States Patent [19]

Matsushima et al.

[11] Patent Number: 5,067,436

[45] Date of Patent: Nov. 26, 1991

[54] COATING APPARATUS

[75] Inventors: Eiji Matsushima; Hidenori Takasaki, both of Hiroshima, Japan

[73] Assignee: Mazda Motor Corporation, Hiroshima, Japan

[21] Appl. No.: 386,435

[22] Filed: Jul. 28, 1989

[30] Foreign Application Priority Data

Jul. 29, 1988 [JP] Japan ..... 63-190778

[51] Int. Cl.[5] ..... B06C 11/00

[52] U.S. Cl. ..... 118/676; 118/323; 427/424

[58] Field of Search ..... 427/421, 424; 118/323, 118/324, 315, 669, 676, 697, 698, 699

[56] References Cited

U.S. PATENT DOCUMENTS 4,448,819 5/1984 Buscher ..... 118/323 X 4,768,462 9/1988 Kurowaga et al. ..... 118/697

FOREIGN PATENT DOCUMENTS 2045463 10/1980 United Kingdom ..... 118/323

*Primary Examiner*—Shrive Beck

*Assistant Examiner*—Alain Bashore

*Attorney, Agent, or Firm*—Fleit, Jacobson, Cohn, Price, Holman & Stern

[57] ABSTRACT

A coating apparatus for spray painting vehicle bodies includes a reciprocating device which carries spray guns located along a conveyor and being operated to move in back and forth directions during spraying. The coating apparatus further includes a relative speed adjusting unit which keeps the spray gun speed at a desirable level in both directions of the reciprocating spray movement, whereby an even coating is obtained. A coating method includes the step of controlling or keeping the relative speed between the article and the spray gun, substantially constant in both directions of movement of the spray gun.

9 Claims, 8 Drawing Sheets

COATING APPARATUS

BACKGROUND OF THE INVENTION

1. Field of the Invention

The present invention relates generally to a coating apparatus and, more particularly, to a coating apparatus for coating vehicle bodies which are conveyed continuously along a production line.

2. Description of Related Art

In a vehicle body coating line, a coating apparatus has been recently utilized for coating chipping paint including urethane paint on the lower side of a vehicle body.

Japanese Patent Publication 59-1107 discloses a painting gun for coating side sills located on vehicle side bodies conveyed successively along a production line. This spray gun moves in the opposite direction to the movement of the conveyed vehicle body, when it coats side sills, and returns to its initial position without spraying. This publication also discloses that the painting gun has two moving speeds, one when the conveyor is running and the other when the conveyor is stopped.

Another known coating method has been proposed which includes a reciprocating unit located beside a vehicle body conveyor. This reciprocating unit, carrying a plurality of spray guns, performs at least one reciprocating painting movement of the spray gun on each vehicle body. However, this conventional reciprocating unit sets a fixed or predetermined speed for the reciprocating movement. Accordingly, the relative speed between the vehicle body and the spray gun is inherently different in each stroke of reciprocating movement, and this difference in the relative speed is likely to cause unevenness in coating.

SUMMARY OF THE INVENTION

In accordance with the present invention, a coating apparatus are provided for obtaining uniform coating of vehicle bodies by controlling the relative speed between the vehicle body and the reciprocating unit.

In carrying out the present invention, in one preferred mode, a coating apparatus for coating paint onto an article is utilized, equipped with reciprocating means to move the spray gun in both back and forth directions during spraying. Further, the apparatus of the present invention includes, to resolve the above-mentioned problem, conveyor speed sensing means, and control means inputting a speed signal from the conveyor speed sensing means and outputting a control signal to the reciprocating means so that the speed of the spray gun is controlled at desirable levels during its back and forth movement in order to obtain an even coating.

A coating method for coating paint onto an article is utilized including the novel step of controlling the relative speed between the article and the spray gun to achieve an even coating. The relative speed may, for example, be controlled so as to be the same in both forward and reverse movements of the spray gun.

BRIEF DESCRIPTION OF THE DRAWINGS

The accompanying drawings show a preferred embodiment of the present invention, in which.

DETAILED DESCRIPTION OF THE PREFERRED EMBODIMENT

Figure 1:
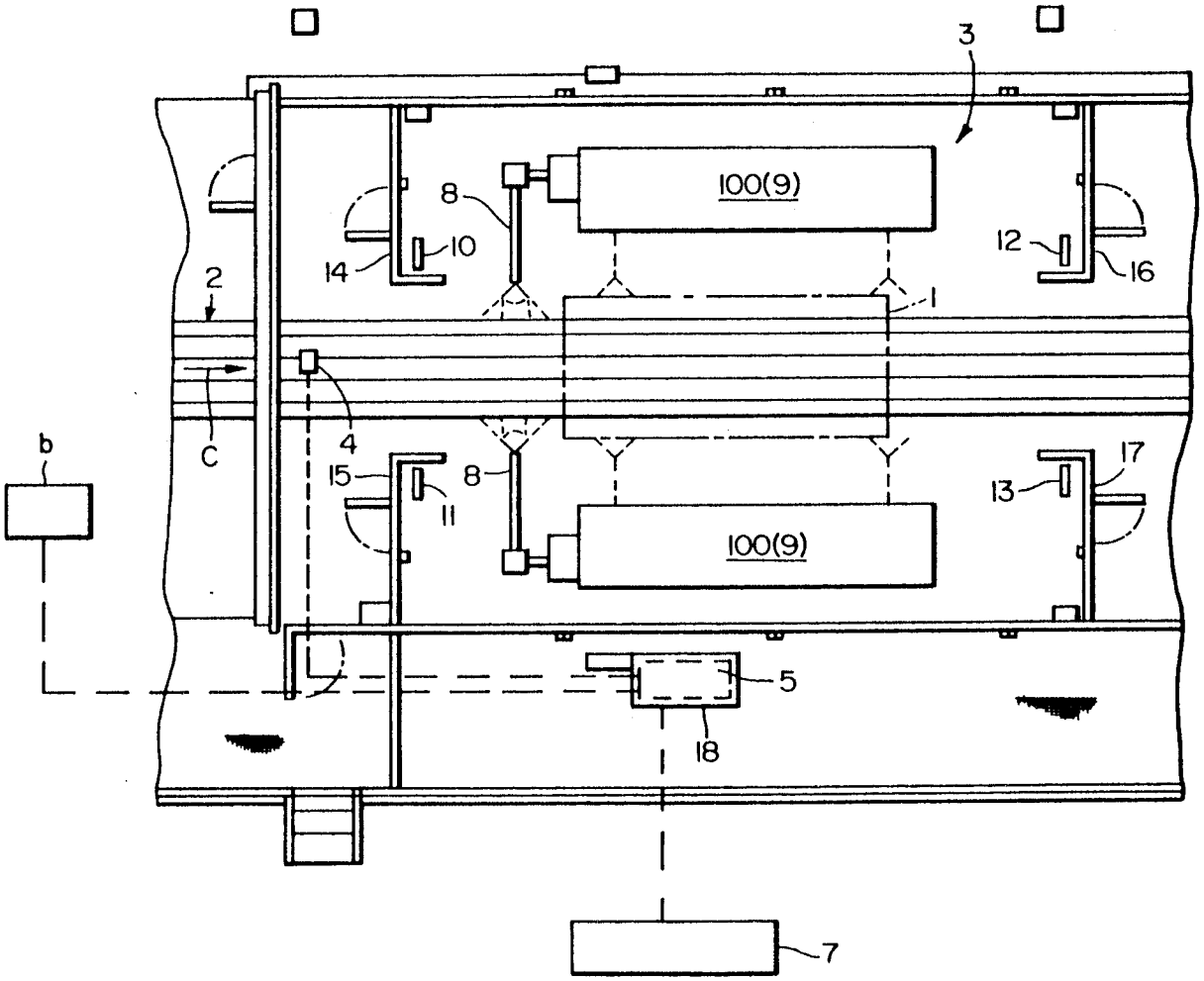
FIG. 1 is a plan view, partly schematic, of a novel coating apparatus.
Figure 2:
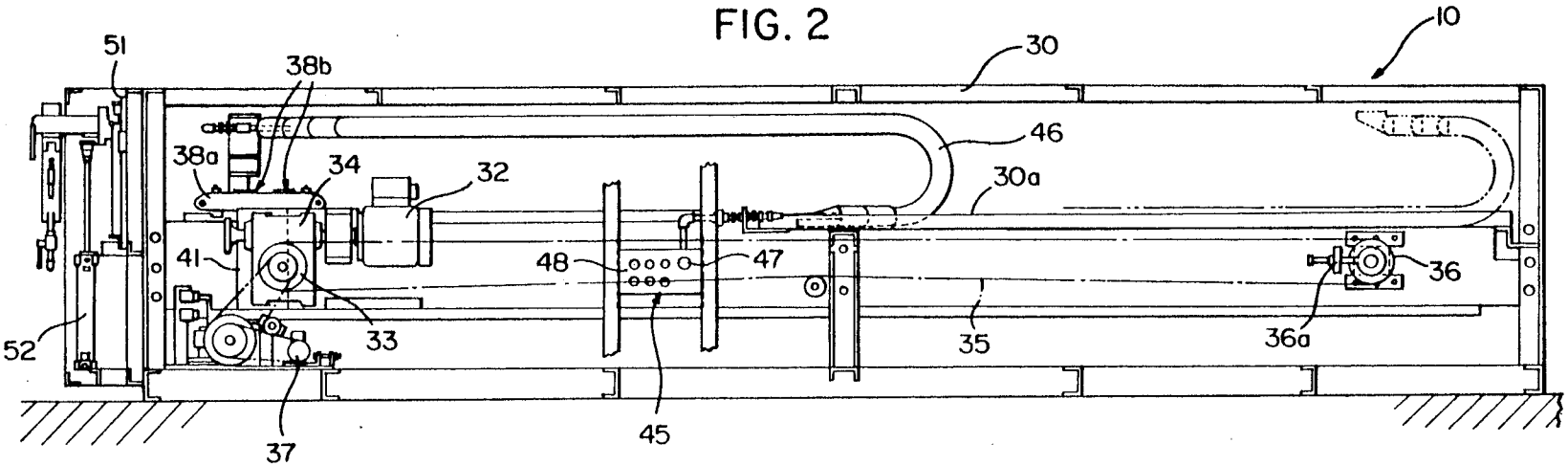
FIG. 2 is a side view of a reciprocating unit.
Figure 3:
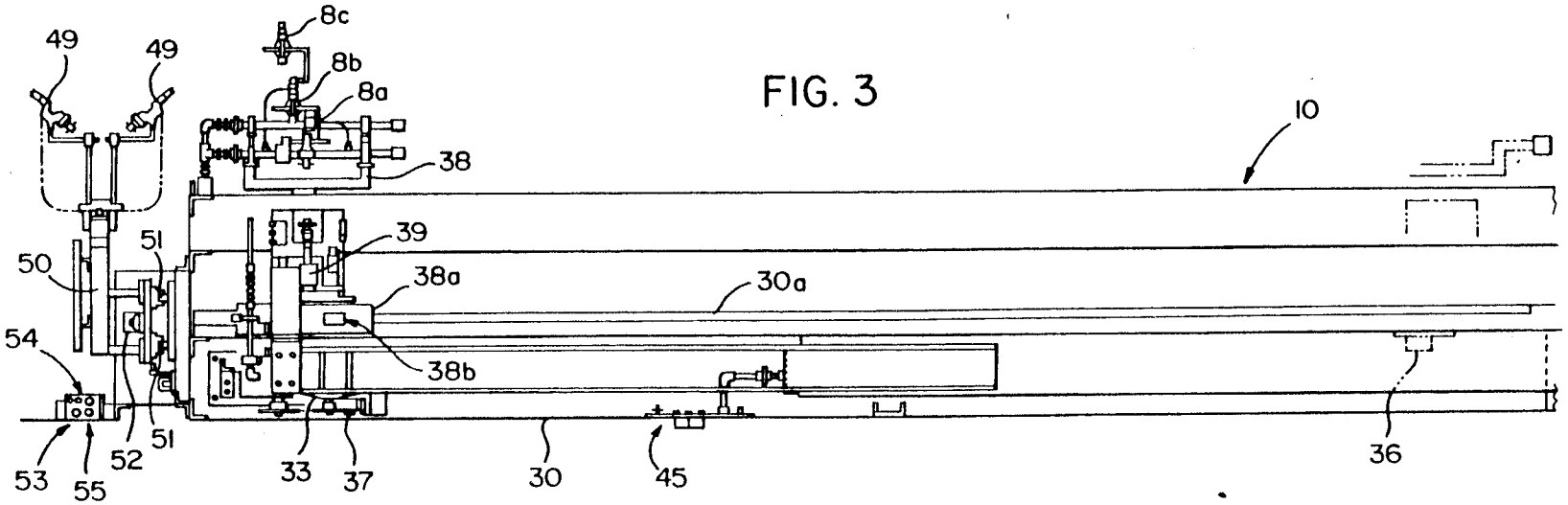
FIG. 3 is a plan view of the reciprocating unit.

Referring now to the drawings, at first, an operational outline of a coating apparatus in accordance with the present invention is explained as follows.

Figure 4:
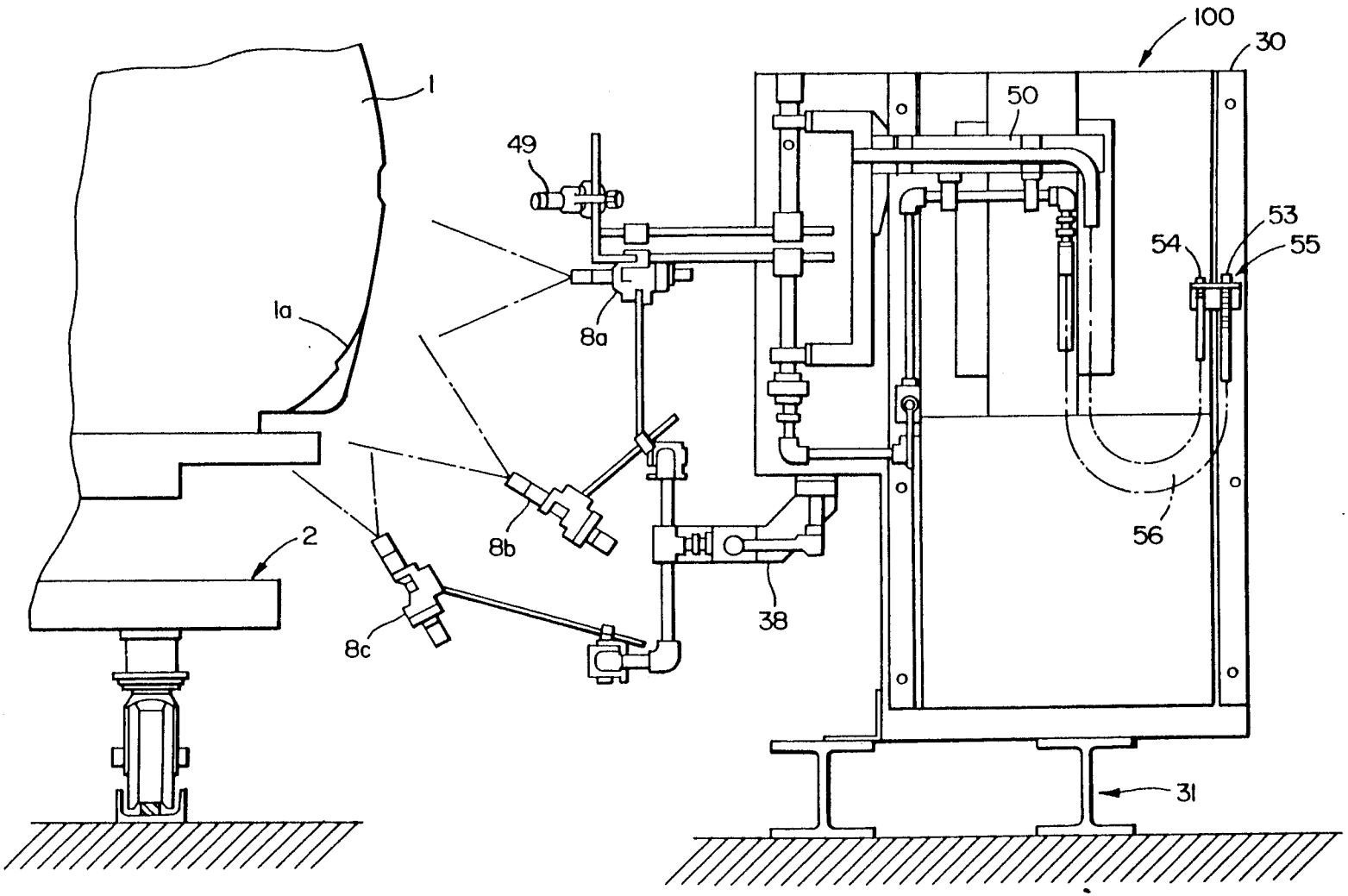
FIG. 4 is a front view of the reciprocating unit.
Figure 5:
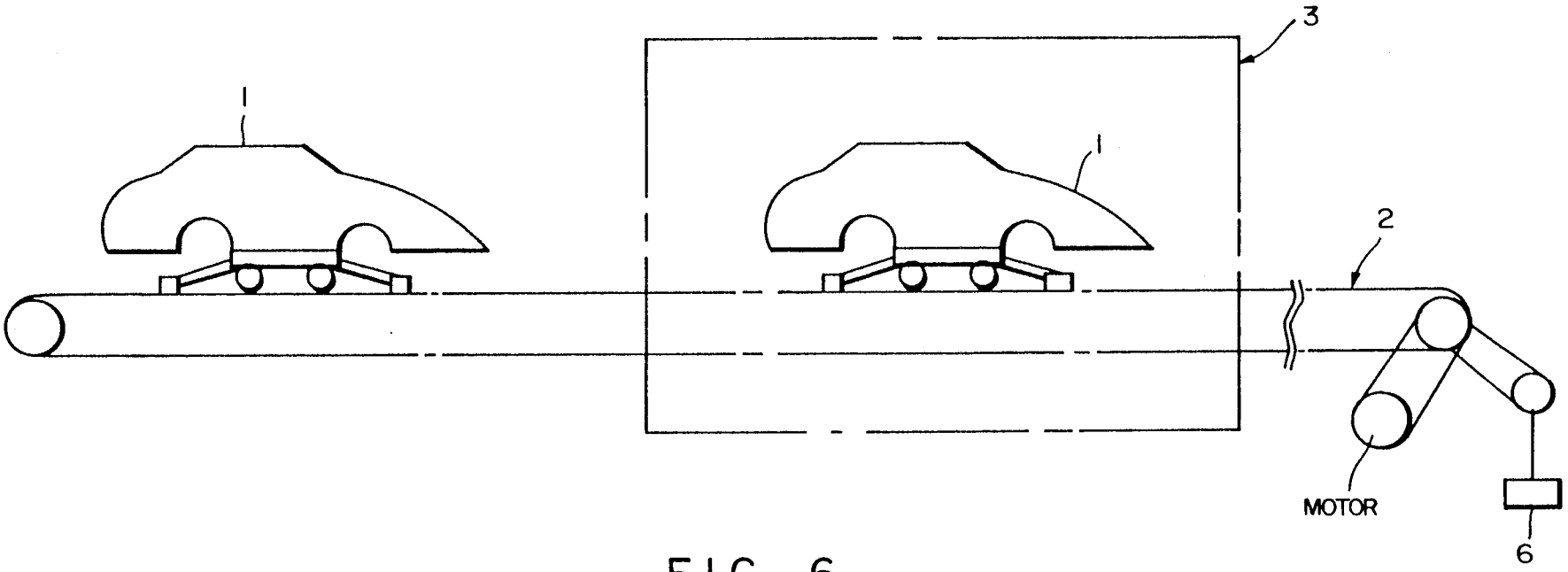
FIG. 5 is a schematic diagram of a conveyor of a vehicle body including a coating station.
Figure 6:
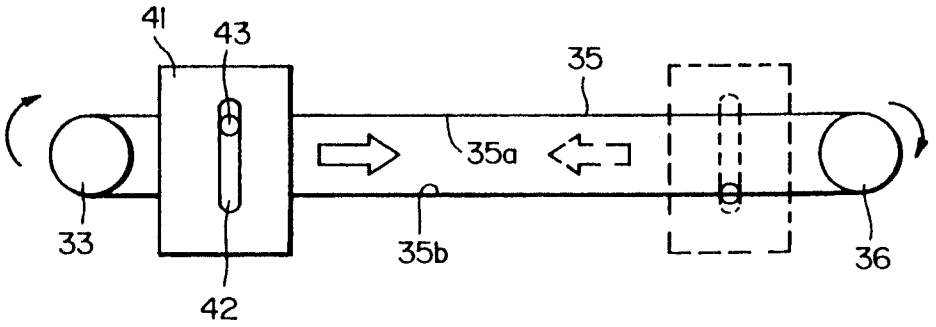
FIG. 6 is a side view, partly schematic, of a connecting device for connecting a gun frame and a reciprocating chain.

Vehicle bodies 1 (FIG. 1) are conveyed successively along a production line with each body 1 being brought into a, coating station 3 along the direction of arrow C by a conveyor 2. A vehicle body 1, when it is conveyed into the coating station 3, pushes or closes a limit switch 4. Upon the switching of the limit switch 4, a control unit 5 is initiated into operation, or actuated. The speed of movement of the conveyor 2 is detected by a conventional conveyor speed detecting device 6 (see FIG. 5). The signal of the conveyor speed detecting device 6 and a signal of vehicle type sent from a host computer 7, are input to the control unit 5. A start timing of a reciprocating unit 9, including a spray gun 8, is determined by calculating an arriving time at which one end of a side sill 1*a* (see FIG. 4) of the vehicle body 1 arrives at a predetermined position indexed to the waiting position of the reciprocating unit 9 including the spray gun 8. This is controlled by the control unit 5 according to the signals of conveyor speed and vehicle type.

At or after the starting time has passed, a coating by the spray gun 8 begins. The spray gun 8 coats chipping paint on the side sill la at a predetermined desirable speed for each stroke of reciprocating movement of the reciprocating unit 9 so that the spray gun 8 keeps a preselected or predetermined relative speed with respect to the side sill 1*a*. The reciprocating unit 9 corresponds to reciprocating means 100. Numerals 10, 11, 12 and 13 denote photo-sensors which detect entrance of a working person into the work zone during an operation of the coating station 3 to prevent an accident. If a photo-sensor detects entry of a person, an automatic cut-off is initiated. Numerals 14, 15, 16 and 17 are safety fences. A numeral 18 denotes a control box containing the control unit 5.

Figure 8:
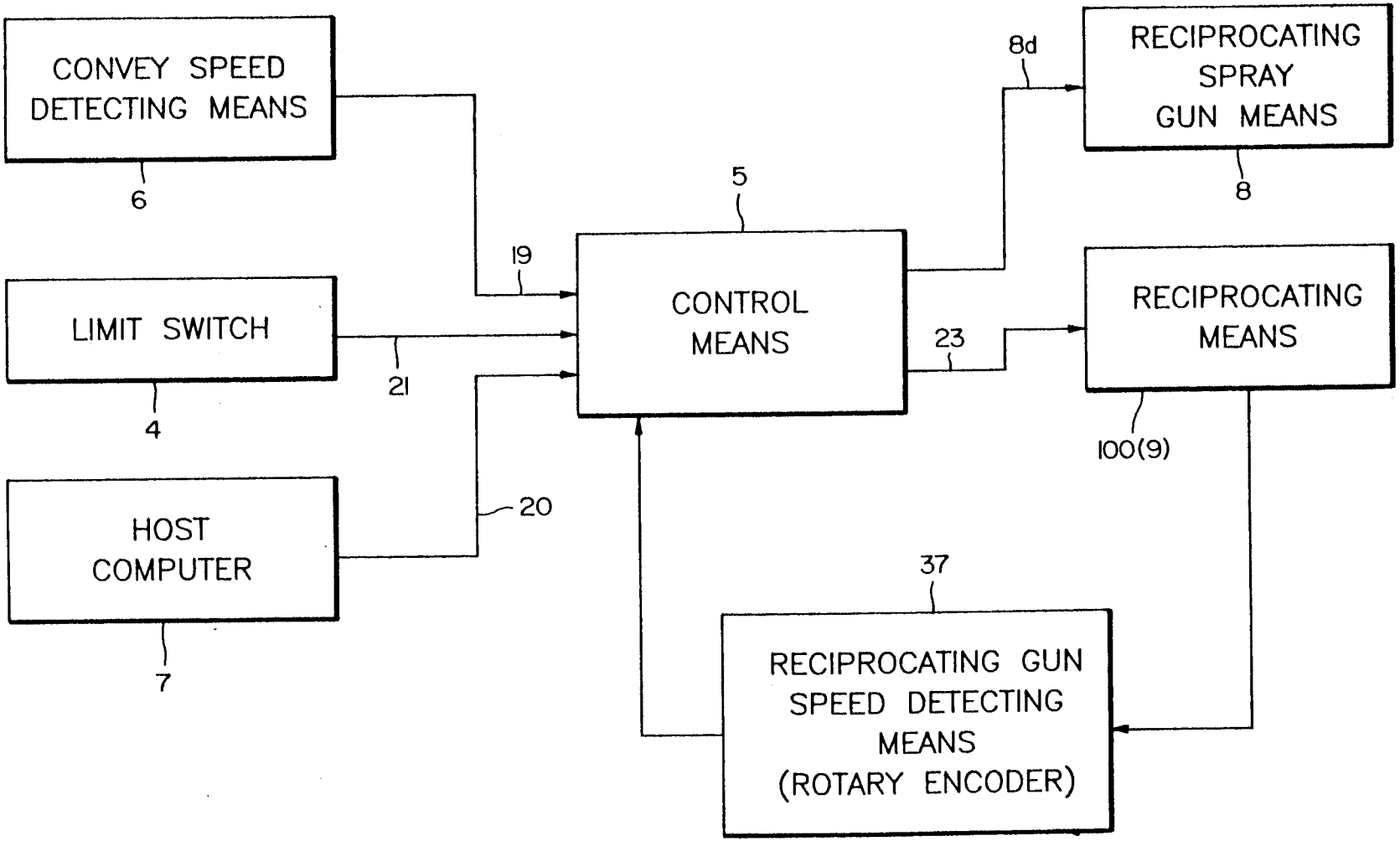
FIGS. 8 and 9 are block diagrams illustrating a novel control system of the coating apparatus.
Figure 9:
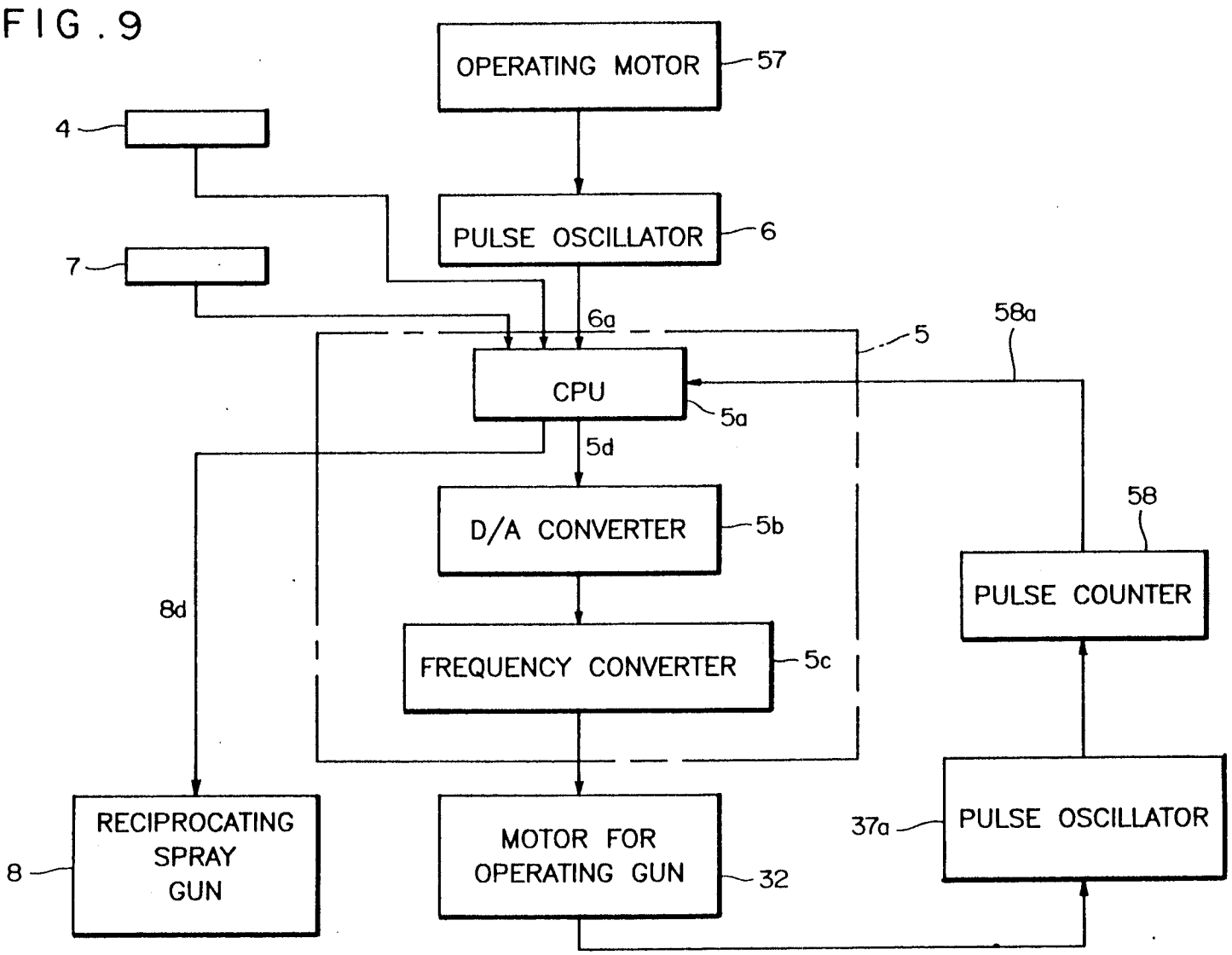

Next, an outline of the control unit 5 is explained referring to FIGS. 8 and 9. A conveyor speed signal 19 from the conveyor speed detecting device 6, a vehicle type signal 20 from the host computer 7 and a vehicle entering signal 21 from the limit switch 4 are input to the control unit 5. The control unit 5 consists of a conventional micro computer system. The control means 5 calculates the target speeds of the spray gun 8 in each stroke of its reciprocating movement so that the relative speed between the spray gun 8 and the vehicle body 1 is maintained at a preselected value during each stroke of the reciprocating movement. The relative speed can be selected according to vehicle type. The control unit 5 outputs a speed adjusting signal 23 corresponding to the target speed by taking into consideration the conveyor speed and the speed of the reciprocating unit 9, i.e., adding the target speed and the conveyor speed when the spray gun 8 moves in the same direction as the vehicle body 1, or reducing the conveyor speed from the target speed when the spray gun 8 moves in the opposite direction as the vehicle body 1.

Furthermore, the control means 5 calculates a position of the spray gun 8 with respect to the vehicle body 1 based on the conveyor speed and the gun speed, in order to control the timing at which the spray gun 8 initiates coating of the chipping paint.

The coating apparatus is structurally explained in more detail as follows.

The reciprocating unit 9 includes a frame structure 30 fixed on a base frame 31 by using angle members. Structure 30 is located along (parallel to) the conveyor 2. A reversible motor 32 that operates the spray gun 8 is mounted at one end of the frame structure 30. Rotation of the output shaft of the motor 32 is transmitted by conventional means to a sprocket wheel 33 of a gear box 34 connected to the motor output shaft. An endless chain 35 is enmeshed with and driven by the sprocket wheel 33 and a freely rotatably mounted sprocket wheel 36 supported on the other end of the frame structure 30. Reference 36*a* designates a conventional take-up or adjusting mechanism to maintain appropriate tension on chain 35.

The sprocket wheel 33 is also connected to a conventional rotary encoder 37 through a transmitting device including belt drives and pulleys. The rotary encoder 37 acts as gun speed detecting means. Thus, the speed of the chain 35 is detected.

Figure 7:
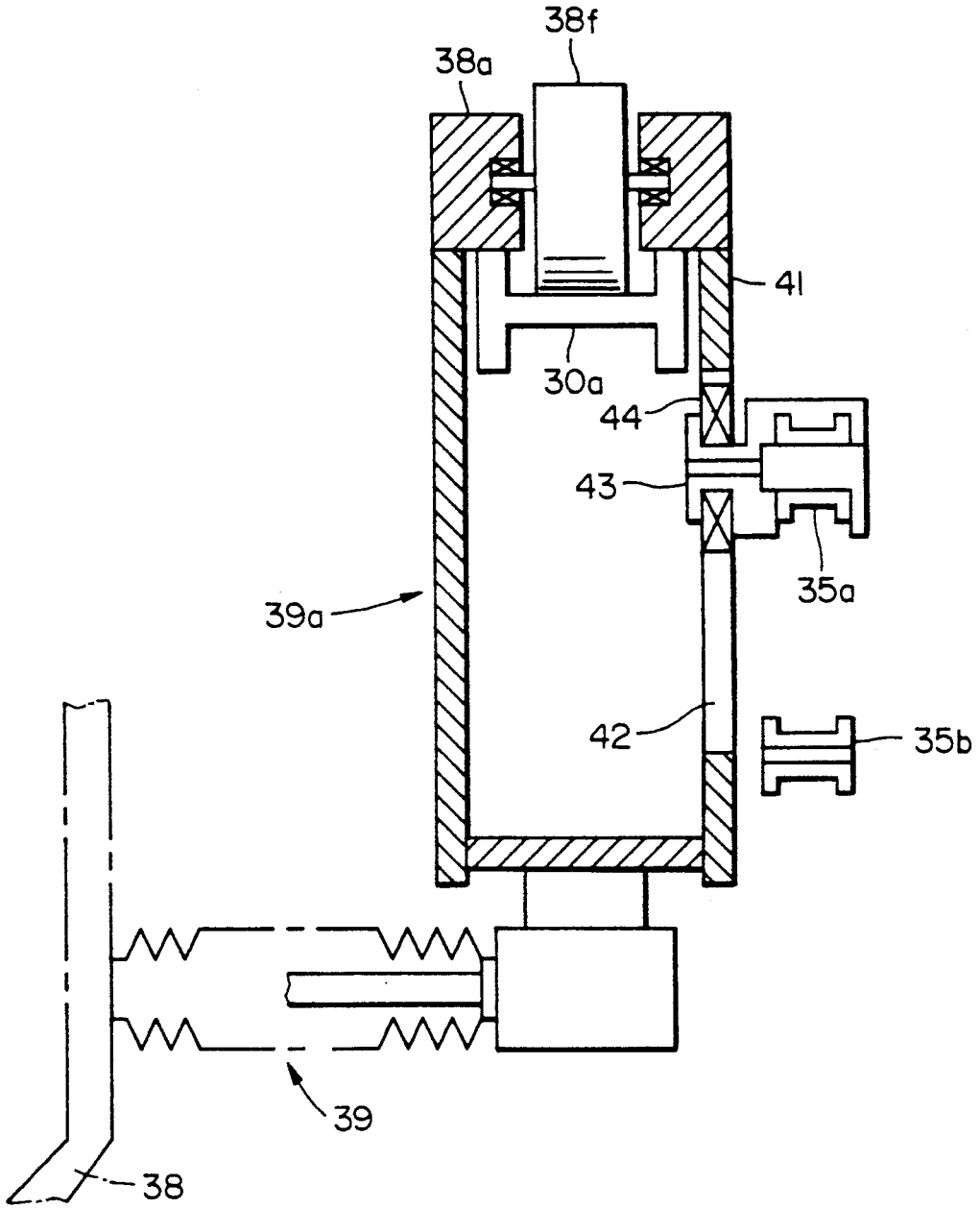
FIG. 7 is a detail view of the connecting device shown in FIG. 6.

Three painting guns 8*a*, 8*b* and 8*c* for coating the chipping paint on the side sill 1*a* are attached to a gun frame 38 which is to be moved alongside the conveyor 2 parallel thereto. These painting guns 8*a*, 8*b* and 8*c* are attached to the gun frame 38 at fixed and predetermined angles with respect to the vehicle body 1. Further, the gun frame 38 is connected to a carrier assembly 39*a* (see FIG. 7) by way of an air cylinder 39. One end portion of the air cylinder 39 is connected to the gun frame 38, and the other end portion of the air cylinder 39 is connected to the carrier assembly. Air cylinder 39 is controlled by the control unit and controls the clearance between the spray guns and the side of the vehicle body to take into account variations in body width.

A connecting plate 41 forming part of the assembly 39*a* has a slit 42 provided normal to the reciprocating chain 35 and overlapping both an upper run 35*a* and a lower run 35*b* of the chain. A pin rod 43 connected at a predetermined position of the reciprocating chain 35 carries a bearing 44 and is mounted in and for movement along the slit 42 when the sprockets 33 and 36 rotate to move the chain. Thus, movement of the chain causes the assembly 39*a* and the spray guns to move back and forth lengthwise along the frame. The assembly 39*a* has a top plate 38*a* which carries a roller 38*f* which runs along a track formed on a longitudinal frame member 30*a*.

Accordingly, the spray guns can be moved in the same direction as a vehicle body 1 when the pin rod 43 is on the upper run 35*a* of the chain. On the other hand, the spray guns can be moved in the opposite or reverse direction when the pin rod 43 is on the lower run 35*b* of the chain. The reciprocating unit 9 turns at the position of the sprockets 33 and 36. Thus, the spray guns and the gun frame 38 are reciprocated along the conveyor 2.

The painting guns 8*a*, 8*b* and 8*c* are connected to a paint intake port 47 and an air intake port 48 on a connecting plate 45 provided on the frame structure 30, by way of a flexible hose 46 so that paint is supplied to the painting guns 8*a*, 8*b* and 8*c*. The painting guns 8*a*, 8*b* and 8*c* are controlled to open or close in known manner for supplying paint.

At the outside of the frame structure 30, two painting guns 49*a* and 49*b* for painting a wheel arch are attached to a gun frame 50 which is guided by a pair of vertical guide rails 51. The gun frame 50 can be moved in an up and down direction by way of an air cylinder 52 also controlled by the control unit. The painting guns 49 and 49 are connected to a paint intake port 53 and an air intake port 54 of a connecting box 55 by way of a flexible hose 56.

Now, referring to FIG. 9, the control system of the coating apparatus is explained in detail. The control unit 5 comprises a CPU 5*a* which performs several calculation procedures, a D/A converter 5*b* which converts a digital speed adjusting signal 23 from the CPU 5*a* to a voltage signal of direct current and a frequency converter 5*c* which converts the voltage signal to a frequency signal. The CPU 5*a* memorizes fixed or predetermined data to calculate a target speed for each stroke of reciprocating movement of the spray guns, so that the CPU 5*a* can calculate a desirable relative speed obtained based on coating condition. The CPU 5*a* inputs a pulse 6*a* as a conveyor speed from a pulse oscillator 6 (conveyor speed detecting means 6) provided at an operating motor 57, and calculates the target speed based on a rotation speed of the motor 57. Therefore, the CPU 5*a* outputs to D/A converter 5*b* a digital signal 5*d* as the speed adjusting signal based on the target speed.

Further, the memorized data includes spare or additional data so that the CPU 5*a* can calculate another target speed when the conveyor 2 stops. The motor 32 (reciprocating operating means 9) accompanies a pulse oscillator 37*a* of the rotary encoder 37 (reciprocating speed detecting means) and a pulse counter 58. The CPU 5*a* inputs a signal 58*a* from the pulse counter 58, and calculates an actual position of the spray gun 8 with respect to the vehicle body 1 based on the signal 58*a*, the conveyor speed signal 19, vehicle type signal and vehicle entering signal 23. Therefore, the spray gun 8 inputs a signal 8*d* from the CPU 5*a* to control an actuation of the spray gun 8.

Figure 10:
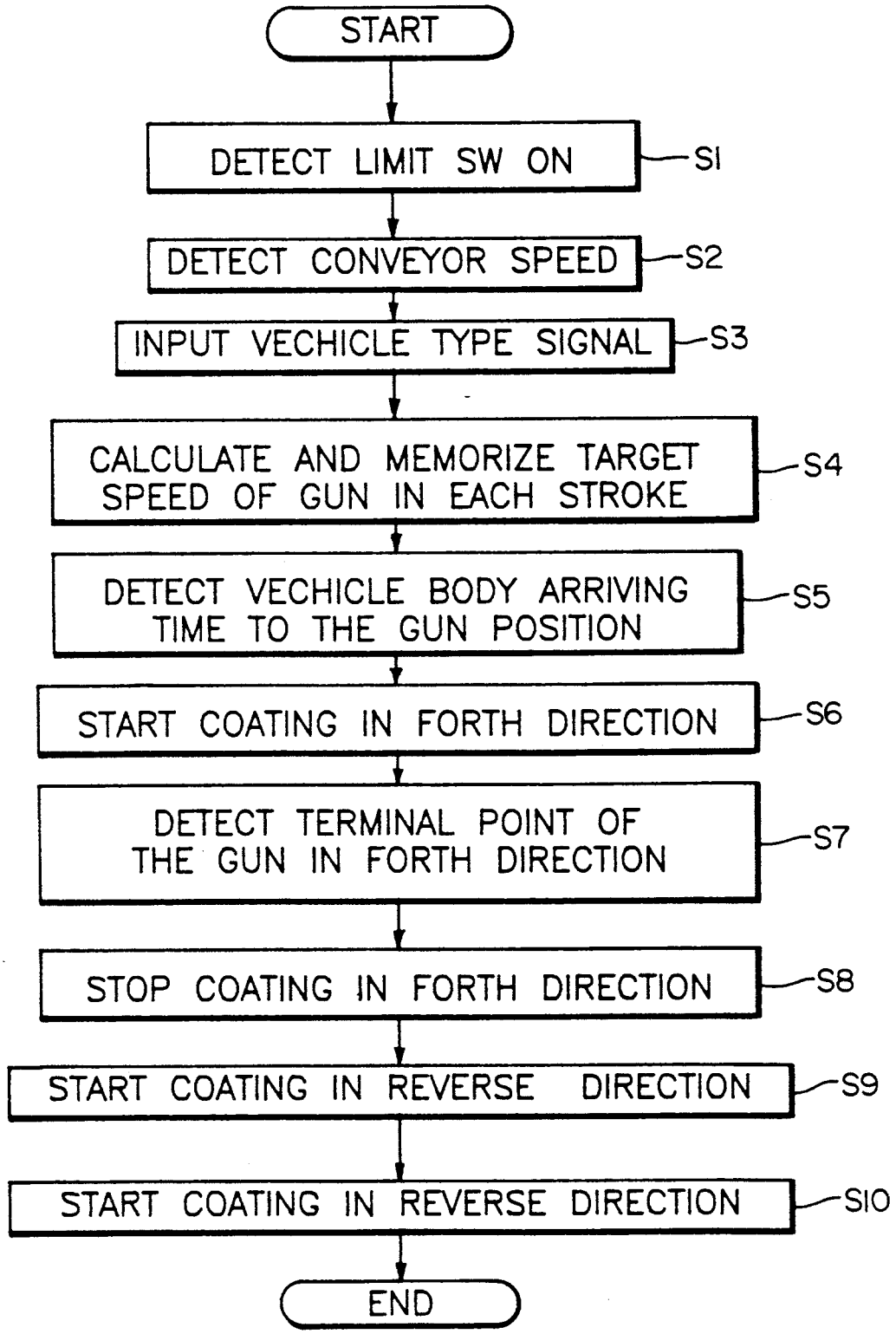
FIG. 10 is a flowchart illustrating a novel operation of the coating apparatus.

Referring now to FIG. 10, an operation of the coating apparatus is described. The vehicle body 1 conveyed on the conveyor 2 enters the coating station 3. When the limit switch 4 is pressed and activated by the vehicle body 1, the control system begins its operation (Step S1). The conveyor speed of the conveyor 2 is detected by conveyor speed detecting means 6 (Step S2). The vehicle type signal 20 is input to the CPU 5*a* from the host computer 7 which controls the vehicle assembly line (Step S3). The CPU 5*a* calculates and memorizes the target speeds of the spray gun 8 in each stroke of the reciprocating movement based on the signals of Steps S2 and S3.

For example, if the desirable relative speed is 336 mm/sec and the conveyor speed is 57 mm/sec, the CPU 5*a* calculates and memorizes the two target speeds of 393 mm/sec, when the spray 8 moves the same direction as the vehicle body, and 279 mm/sec when the spray 8 moves in the opposite direction to the vehicle body 1 (Step S4). Further, the CPU 5*a* calculates the actual position of the spray gun 8 with respect to the vehicle body 1 based on a moving distance of the vehicle body 1 obtained by integrating the conveyor speed. The CPU 5*a* detects the time for the side sill 1*a* of the vehicle body 1 to arrive at the waiting position of the spray gun 8, by calculating the time based on the information of the actual position of the vehicle body 1 and vehicle type signal 20 (Step S5). At the same time, the motor 32 of the reciprocating unit 9 is operated to move the spray gun 8 at the calculated speed based on the calculated target speed in the forward direction (Step S6).

As mentioned above, the actual position of the spray gun 8 with respect to the vehicle body 1 is calculated by using feedback control where the rotational speed of the motor 32 is input to the CPU 5*a* through the pulse oscillator 37*a* and the pulse counter 58. Therefore, the timing of the actuation of the spray gun 8 is controlled according to the actual position of the spray gun with respect to the vehicle body 1. The spray gun 8 coats paint on the vehicle body 1 at a speed maintaining or keeping the predetermined or calculated relative speed even if the conveyor changes its speed.

A terminal portion in the forward direction of the spray gun 8 is detected by integrating the number of rotations of the motor 32 (Step S7). At this terminal position, the coating procedure in the forward direction substantially ends (Step S8).

Next, the pin rod 43 extended from the reciprocating chain 35 is shifted from the upper run 35*a* to the lower run 35*b* of the chain 35. Thus, the spray gun 8 returns or moves back. The motor 32 of the reciprocating unit is moved at the target speed in reverse direction calculated by the CPU 5*a* and the coating in reverse direction begins (Step S9). The terminal position in the reverse direction of the spray gun 8 is detected by integrating the number of rotations of the motor 32. At this terminal position, the coating procedure in the reverse direction substantially ends. Finally, the motor 32 is stopped so that the gun 8 is located at the initial or waiting position (Step S10).

The above explanation describes one cycle for coating paint by using the coating apparatus in accordance with the present invention. This cycle is repeated when a further vehicle body on the production line is conveyed into the coating station 3.

The relative speed of the spray gun 8 with respect to the vehicle body 1 can be selected freely according to coating conditions. The relative speed may be different in each stroke of the reciprocating movement, if the difference does not affect the evenness of the coating.

This invention may be embodied in other specific forms without departing from the spirit or essential characteristics thereof. The present embodiment is, therefore, to be considered in all respects as illustrative and not restrictive, the scope of the invention being defined by the appended claims rather than by the foregoing description. All changes which come within the meaning and range of equivalency of the claims are, therefore, intended to be embraced therein.

We claim:

1. A coating apparatus for coating paint on articles, comprising:

conveyor means for conveying the articles, in a first direction, successively through a coating station located along the conveyor means;

a spray gun for applying paint on each article as the article moves, in said first direction, through said coating station;

reciprocating means, carrying said spray gun, provided in the coating station, said reciprocating means and said spray gun moving back and forth in the coating station along the conveyor means in said first direction and in a second direction, opposite to said first direction, the spray gun applying paint to each article substantially throughout movement of said spray gun in said first and second directions;

operating means for moving the reciprocating means and the spray gun in said first and second directions; and control means for providing an operational signal to the operating means for controlling a moving speed of the spray gun in the first direction and a moving speed of the spray gun in the second direction such that a first relative speed between the article and the spray gun during movement of the spray gun in said first direction and a second relative speed between the article and the spray gun during movement of the spray gun in the second direction are substantially the same as the article moves in said first direction and the spray gun moves in said first and second directions.

2. A coating apparatus for coating paint on articles, comprising:

conveyor means for conveying the articles, in a first direction, successively through a coating station located along the conveyor means;

a spray gun for applying paint on each article as the article moves, in said first direction, through said coating station;

reciprocating means, carrying sad spray gun, provided in the coating station, said reciprocating means and said spray gun moving back and forth in the coating station along the conveyor means in said first direction and in a second direction, opposite to said first direction, the spray gun applying paint to each article substantially throughout movement of said spray gun in said first and second directions;

operating means for moving the reciprocating means and the spray gun in said first and second directions;

conveyor speed detecting means for detecting conveyor speed;

gun speed detecting means for detecting the moving speed of the spray gun in said first direction and the moving speed of the spray gun in said second direction; and control means for processing input signals from the conveyor speed detecting means and gun speed detecting means and generating an operational signal for the operating means for controlling said moving speed of the spray gun in the first direction and said moving speed of the spray gun in the second direction such that a first relative speed between the article and the spray gun during movement of the spray gun in said first direction and a second relative speed between the article and the spray gun during movement of the spray gun in the second direction are substantially the same as the article moves in said first direction and the spray gun moves in said first and second directions so as to obtain an even coating of paint on each article.

3. A coating apparatus in accordance with claim 1, wherein said control means determines the first and second relative speeds according to vehicle type.

4. A coating apparatus in accordance with claim 2, wherein said control means determines the first and second relative speeds according to vehicle type.

5. A coating apparatus in accordance with claim 2, wherein said control means has means for memorizing a target relative speed and adjusting the moving speeds of the spray gun in said first and second directions by using feedback-control based on the signals of the conveyor speed detecting means and gun speed detecting means.

6. A coating apparatus in accordance with claim 1, wherein said operating means is electric motor means.

7. A coating apparatus in accordance with claim 2, wherein said operating means is electric motor means.

8. A coating apparatus in accordance with claim 2, wherein said control means includes means for calculating and memorizing a target speed in each stroke of movement of the spray gun in said first and second directions, based on vehicle type and conveyor speed, and the operational signal is adapted to equalize the moving speeds of the spray gun in said first and second directions and the target speed.

9. A coating apparatus in accordance with claim 2, wherein said conveyor speed detecting means is rotational speed detecting means for detecting a rotational speed of the operating means.

* * * * *